US006962188B2

(12) United States Patent
Coenraets

(10) Patent No.: US 6,962,188 B2
(45) Date of Patent: Nov. 8, 2005

(54) DEVICE WITH FLEXIBLE SHUTTER

(75) Inventor: Benoit Coenraets, Brussels (BE)

(73) Assignee: Dynaco International, S.A., Brussels (BE)

( * ) Notice: Subject to any disclaimer, the term of this patent is extended or adjusted under 35 U.S.C. 154(b) by 0 days.

(21) Appl. No.: 10/473,805

(22) PCT Filed: Mar. 29, 2002

(86) PCT No.: PCT/BE02/00049

§ 371 (c)(1),
(2), (4) Date: Apr. 26, 2004

(87) PCT Pub. No.: WO02/084063

PCT Pub. Date: Oct. 24, 2002

(65) Prior Publication Data

US 2004/0168775 A1 Sep. 2, 2004

(30) Foreign Application Priority Data

Apr. 2, 2001 (EP) ..... 01201245
May 29, 2001 (BE) ..... 2001/0366

(51) Int. Cl.[7] ..... E06B 7/28
(52) U.S. Cl. ..... 160/180; 160/237
(58) Field of Search ..... 160/10, 121–1, 160/180, 264, 25, 349.1, 116, 128, 237; 135/117; 24/381

(56) References Cited

U.S. PATENT DOCUMENTS 5,819,474 A * 10/1998 Strom ..... 52/4
5,988,256 A * 11/1999 Winters ..... 160/310

FOREIGN PATENT DOCUMENTS

| | | |
|---|---|---|
| EP | 0 992 650 | 4/2000 |
| EP | 1 029 557 | 8/2000 |
| FR | 2 684 008 | 5/1993 |
| GB | 2 108 839 | 5/1983 |
| WO | WO 99/35360 | 7/1999 |

* cited by examiner

*Primary Examiner*—Blair M. Johnson
(74) *Attorney, Agent, or Firm*—Browdy and Neimark, PLLC

(57) ABSTRACT

This invention concerns a flexible shutter system combined with drive systems in such a way as to permit the shutter (1) to move vertically between a closed position and an open position, said shutter (1) being intended to close an opening (5) or other aperture, the shutter (1) having at least one area of low resistance (11) which, in the closed position, extends from the lower edge (4) of the shutter (1) to a certain height on the latter (1), in such a way as to permit the creation of at least one access aperture if the shutter (1) is broken at the location of said area of low resistance (11).

20 Claims, 8 Drawing Sheets

DEVICE WITH FLEXIBLE SHUTTER

This invention concerns a flexible shutter system combined with drive systems in such a way as to move the shutter along a specific path between a closed and an open position, said shutter being intended to close an opening or other aperture. In such a system, the side edges of the shutter are held in parallel guide tracks for at least part of their path.

If, for any reason, the drive systems cannot be activated when the shutter is in its closed position, existing systems of this type render it impossible to pass through the aperture closed by the shutter.

Such a situation arises, for example, if persons present on premises in which a safety aperture is closed by such a shutter system have to be evacuated very quickly. For example, if people panic and move 'en masse' towards the emergency exit of a large store due to a fire, the shutter may be jammed in its closed position due to a malfunction and it will sometimes be impossible to open the shutter closing this emergency exit.

The use of a shutter of which the side edges move in guide tracks is thus prohibited in many countries, for safety reasons.

The purpose of the invention is to remedy these drawbacks. It is intended to provide a shutter system which can be used as an emergency exit and which can be opened very quickly without having to operate the drive systems. To this end, the inventive shutter has at least one area of low resistance which, in the closed position, extends from the lower edge of the shutter to a certain height above said edge, to allow the formation of an exit aperture if the shutter is broken at the location of said area of low resistance.

In one particularly advantageous embodiment, the area of low resistance is formed by a cutout in the shutter, the edges of which are connected by removable means.

It is advantageous if the edges of the area of low resistance overlap each other at least partially.

In an interesting embodiment of the inventive shutter system, detection systems are provided to permit monitoring of whether the area of low resistance has been broken. Said detection systems combine with the drive systems to prevent the shutter being moved towards its open position if it has been broken in the area of low resistance, i.e. if the aforementioned exit aperture is open.

In a specific embodiment of the inventive shutter system, the aforementioned detection systems include an electrical circuit connected to drive systems which is broken if the shutter is broken in the area of low resistance.

Other details and particular features of the invention emerge from the description provided below, in non-exhaustive examples of several specific embodiments with references to the drawings appended hereto.

The same reference numbers refer to the same or analogous components in the various drawings.

In general, this invention concerns a shutter system with an emergency exit, combined with drive systems such as a drum of which the spindle is connected to the shaft of a motor. The shutter, which can move between a closed position and an open position, is intended to close an access opening in a wall or any aperture.

For the purposes of this invention, the word "shutter" should be understood as any component which is at least partially pliant, flexible or semi-rigid with one or more stiffeners, such as a tarpaulin, a strip of plastic material, wire mesh, a trellis, etc. More specifically, it involves a shutter which may be folded or wound around a spindle at right angles to its direction of movement between its open and closed positions.

However, it should be noted that pronounced preference is given to flexible shutters formed, for example, by a tarpaulin. The drawings thus concern a shutter made up of a tarpaulin of which the side edges have, for example, a bead or a series of blocks.

Figure 1:
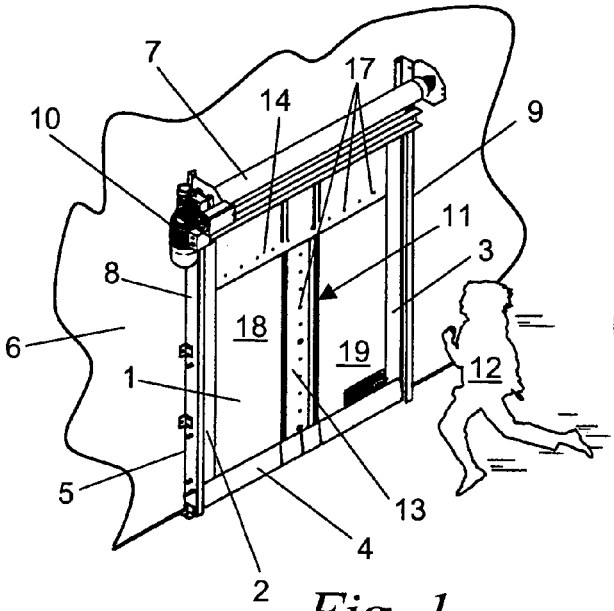
FIG. 1 is a diagrammatic front and parallel perspective view of an inventive shutter system in its closed position, mounted in an opening in a wall.

The inventive system shown in FIG. 1 consists of a shutter 1 with side edges 2 and 3 running in guide tracks 8 and 9, and a lower edge 4, which may have one or more stiffeners or a weighting strip. Said shutter 1 is used to close an opening 5 in a wall 6 and may be moved between a closed position, as shown in FIG. 1, and an open position. In the open position, the shutter 1 is wound on the drum 7, which is located above the opening 5. When shutter 1 opens, its side edges 2 and 3 run in vertical guide tracks 8 and 9 which extend on either side of the opening 5. The drum 7 is driven by drive systems consisting of an electric motor 10 and control systems (not shown). When the drum 7 rotates about its axis, the shutter 1 is wound or unwound and consequently moves towards its open or closed position.

Figure 2:
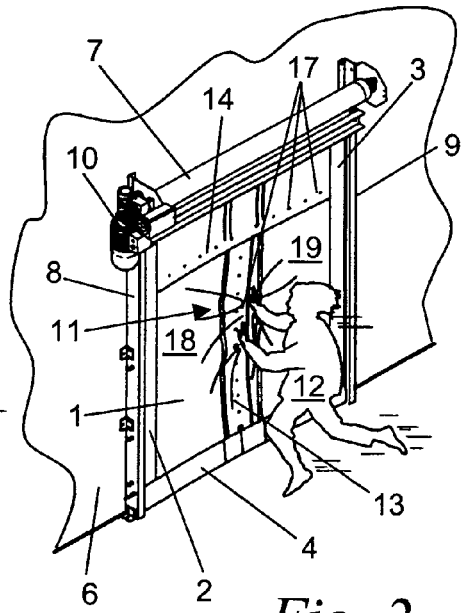
FIG. 2 is a view analogous to that in FIG. 1, showing a person attempting to pass through the opening.

The shutter 1 has an area of low resistance 11 which may broken relatively easily if a person 12 pushes against the shutter 1, as shown in FIG. 2.

This area of low resistance 11 contains a first zone 13, which extends from the lower edge 4 of the shutter 1 to a certain height above said lower edge 4, e.g. about two metres, and a second zone 14, which preferably extends horizontally to within a short distance of the side edges 2 and 3 of the shutter 1.

Consequently, the area of low resistance 11 is in the shape of a T in this case.

Zones 13 and 14 of the area of low resistance 11 are formed by a cutout in the shutter 1 extending in the direction of said zones 13 and 14.

The edges 15 and 16 of the cutout are connected by removable means, e.g. by press-studs 17, and overlap. In this way it is possible to reconnect the edges 15 and 16 of the cutout after breakage of the area of low resistance 11.

Figure 3:
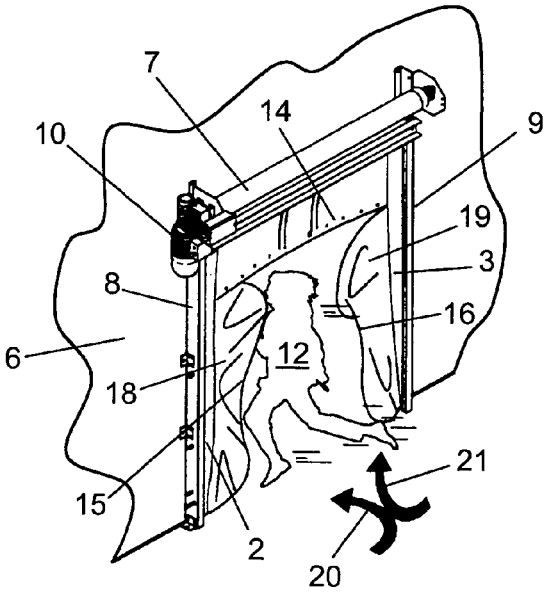
FIG. 3 is a view analogous to that in FIGS. 1 and 2, showing a person passing through the opening, the shutter being broken and forming two flexible leaves.
Figure 4:
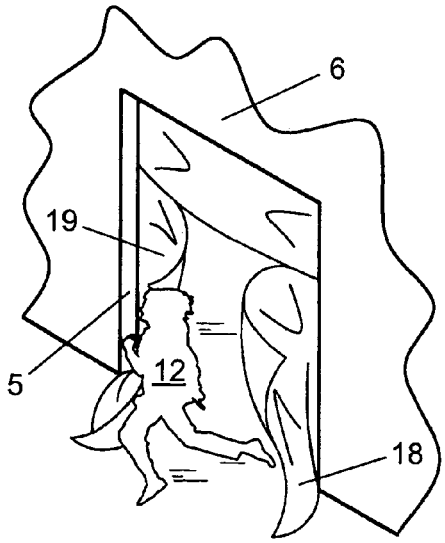
FIG. 4 is a diagrammatic parallel perspective view of the shutter system in FIGS. 1 to 3 from the opposite side of the shutter, with a person having passed through the opening.

If the shutter 1 is broken at the location of the area of low resistance 11 by a person 12 wishing to pass through an opening closed by the shutter 1, as shown in FIG. 2, two flexible leaves 18 and 19 are formed, as shown clearly in FIG. 3. The leaves 18 and 19 are demarcated, firstly, at the sides, by the side edges 1 and 3 of the shutter 1, and secondly, horizontally, in their upper area, by the cutout of the area of low resistance 14 extending between the side edges 2 and 3 of the shutter 1.

The leaves 18 and 19 are then open in the direction indicated by the arrows 20 and 21.

Detection systems combined with the shutter drive systems are provided in order to prevent the shutter 1 from being wound when it has been broken in the location of the area of low resistance 11. These drive systems include the electric motor 10 and control systems 22 for operating it. In the embodiment of the inventive shutter system shown in FIG. 5, the detection systems include an electrical circuit 23, shown diagrammatically by broken lines.

This electrical circuit 23 is connected to the control systems 22 in such a way that the motor 10 cannot be operated if the shutter 1 is broken at any point whatsoever in the area of low resistance 11. In particular, if the shutter 1 is broken at this point, the electrical circuit 23 will be broken.

For this purpose, the electrical circuit 23 has at least one contact 24, consisting of an electrical conductor on each of the edges 15 and 16 of the area of low resistance 11. If the shutter 1 is not broken, and consequently the edges 15 and 16 are connected, the electrical conductor on edge 15 will make contact with the electrical conductor on edge 16 of the cutout.

Figure 5:
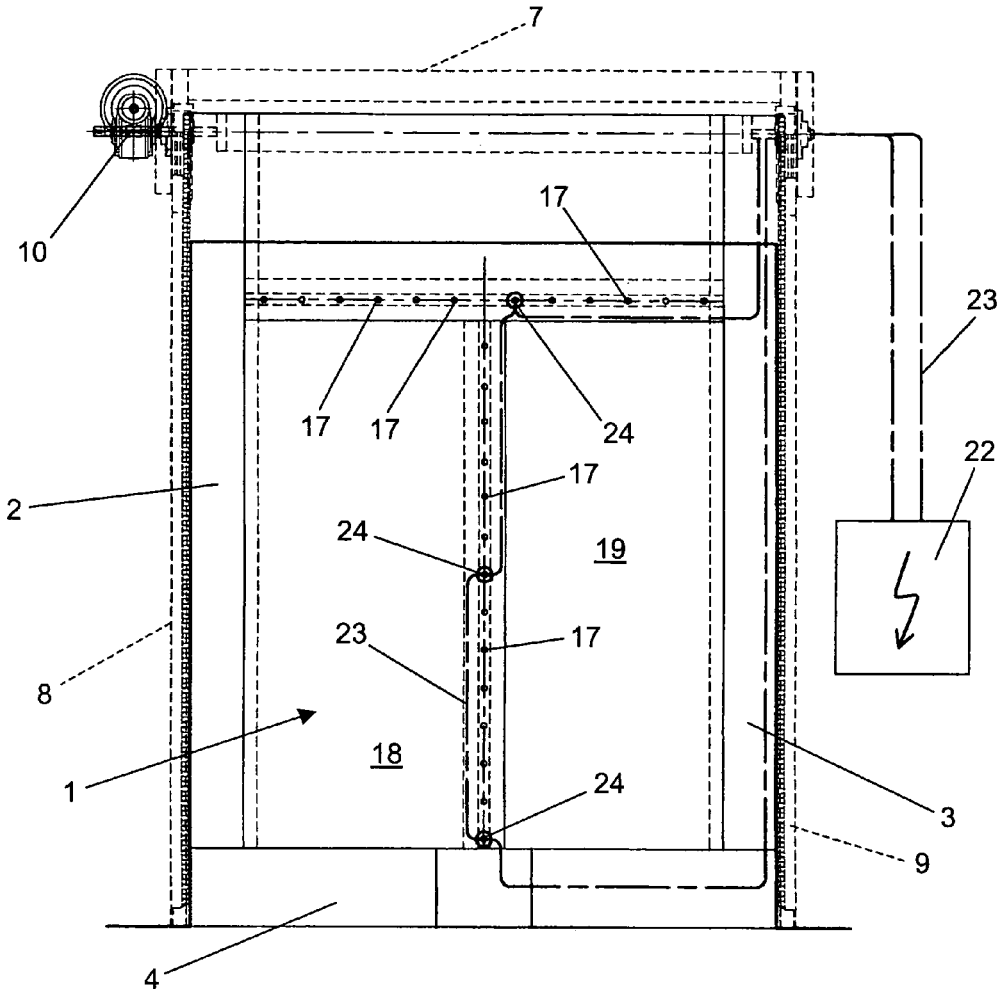
FIG. 5 is a diagrammatic front elevation of an inventive shutter system with an electrical circuit allowing detection of whether the shutter has been broken.

Advantageously, multiple contacts 24 are provided in the area of weak resistance 11, as shown in FIG. 5. These contacts 24 are connected in series, so that as soon as one contact 24 is broken, the shutter 1 can no longer be opened by vertical movement until electrical contact has been restored.

Figure 6:
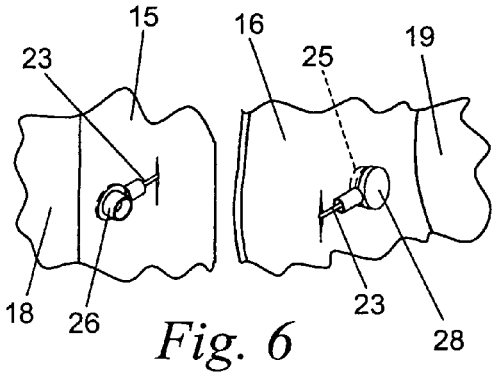
FIG. 6 is a diagrammatic view of part of the edges of an area of low resistance of the shutter, with a press-stud.
Figure 7:
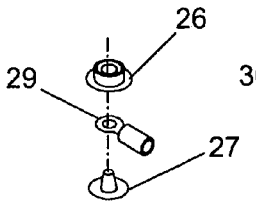
FIG. 7 is a diagrammatic exploded view of a stud from a press-stud system.
Figure 8:
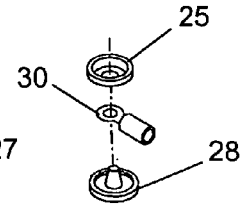
FIG. 8 is a diagrammatic exploded view of a cap for a press-stud system.

FIGS. 6 to 8 show contacts 24 in the form of press-studs. Each of these press-studs consists of a stud 25 attached to an edge of the area of low resistance 11 and a cap 26 attached to the other edge of this area at a corresponding point. The electrical circuit 23 is connected firstly to the stud 25 and secondly to the cap 26 so that the electrical circuit 23 is broken if this press-stud is released.

The stud 25 is attached to the edge 15 or 16 of the area of low resistance 11 by means of a pin 27, which pierces the shutter 1 and which is attached to the cap 26. A ring 29 connected to the electrical circuit 23 is inserted between the pin 27 and the cap 26.

In the same way, a ring 30 connected to the electrical circuit 23 is inserted between the cap 26 and a corresponding pin 28 in order to attach the cap 26 to the edge 16 or 15 opposite the stud 25.

The electrical circuit 23 shown in FIG. 5 contains an electrically-conductive wire which connects three contacts 24 formed by press-studs of the aforementioned type. This wire is incorporated into the shutter 1 and is connected to the control systems 22.

In addition to the press-studs 24 acting as electrical contacts, other press-studs 17 are provided along the edges 15 and 16 of the cutout of the area of low resistance 11 in order to ensure proper closure of the shutter 1.

In another embodiment of the inventive shutter system, the area of low resistance 11 may consist of a line of low resistance along which the shutter 1 may be broken. The contact 24 then represents a weak point at the location of this line, so that the electrical circuit 23 is broken if the shutter is broken along it.

Figure 9:
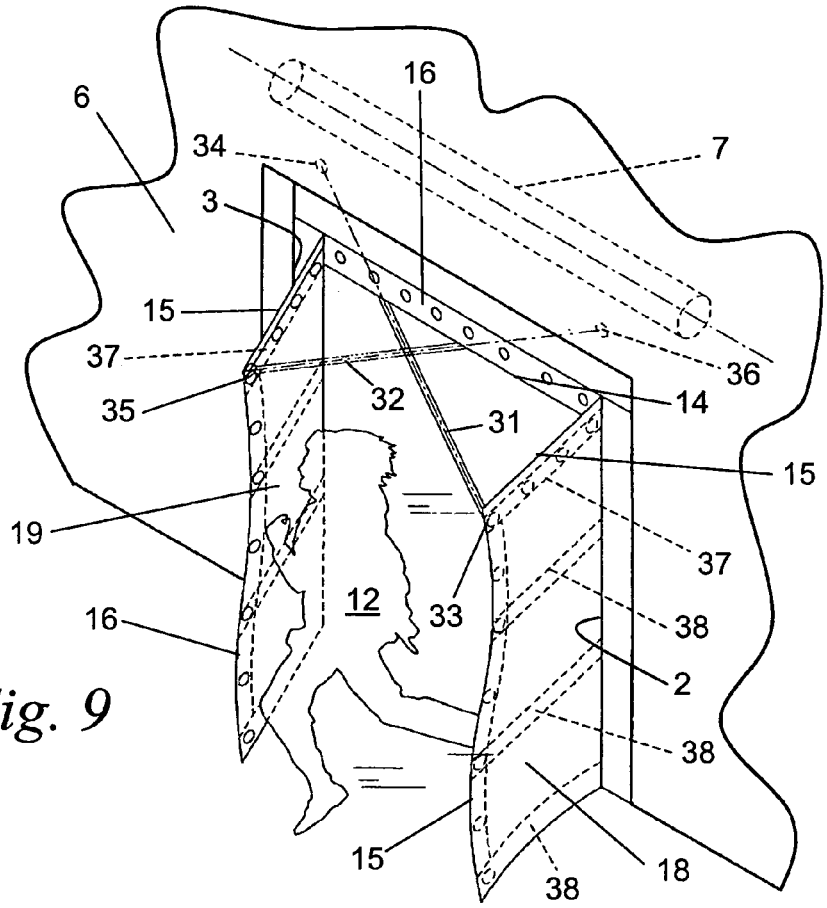
FIG. 9 is a diagrammatic parallel perspective view of another embodiment of the inventive shutter system in its closed position, fitted in an opening in a wall.
Figure 10:
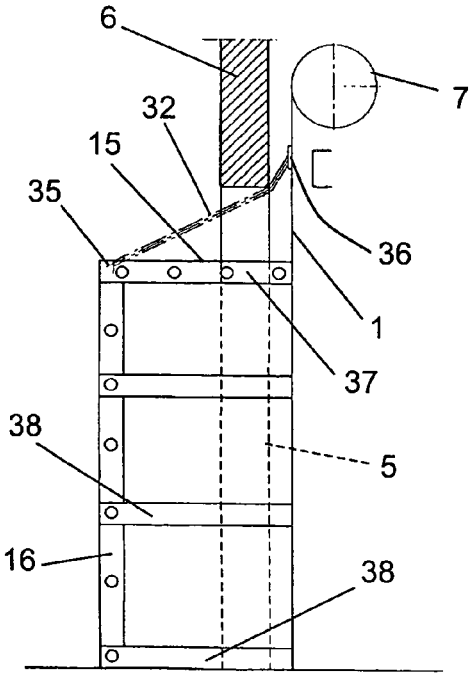
FIG. 10 is a diagrammatic vertical section through the system shown in FIG. 9, when the shutter is broken and forms two leaves.
Figure 11:
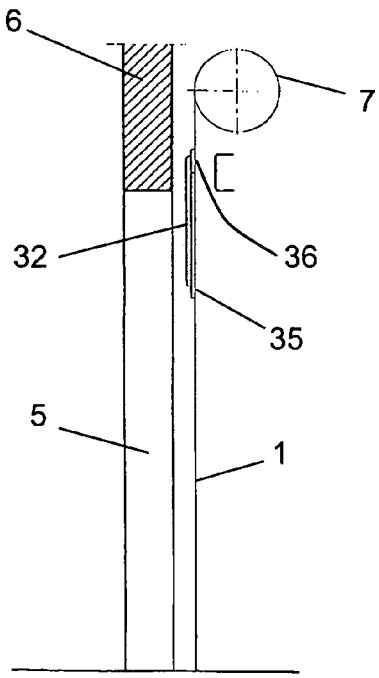
FIG. 11 is a section analogous to that in FIG. 10, with the leaves in the plane of the shutter.

FIGS. 9 to 11 show a very interesting embodiment of the invention, in which the shutter 1 is provided with automatic closure systems. These closure systems allow the leaves 18 and 19 to be returned to the plane of the shutter 1 in order to close the access aperture formed by breakage of the shutter 1 in the location of the area of low resistance 11.

The closure systems thus include a flexible connection, e.g. a helical spring or elastic strip, connecting the edges 15 and 16 of the horizontal zone of low resistance 14 together.

The shutter 1 in FIGS. 9 to 11 represents a T-shaped area of low resistance 11. In this way, the leaves 18 and 19 have a rectangular shape of which the upper edge is formed by the edge 15 of the horizontal zone of low resistance 14.

In order to allow automatic closure of the aperture in the shutter 1, the aforementioned closure systems include elastic strips 31 and 32 which connect the edges 15 of the leaves 18 and 19 to the part of the shutter 1 above the edge 16. In particular, one end 33 of the elastic strip 31 is connected to the leaf 18 contiguous to the side edge 2 of the shutter 1, whilst the other end 34 is attached to the shutter 1 above the other leaf 19 in the vicinity of the other side edge 3 of the shutter 1. In this way, the elastic strip 31 will return the leaf 18 to the plane of the shutter 1.

In the same way, the ends 35 and 36 of the other elastic strip 32 are attached to other leaf 19 and to the shutter 1 above the leaf 18 respectively.

As FIG. 10 clearly shows, the elastic strips 31 and 32 extend across the opening 5 when an access aperture is formed in the shutter 1.

In order to allow the leaves 18 and 19 to be returned to the plane of the shutter 1 easily, the leaves are provided with at least one stiffener 37 extending from the upper edge of the leaves and preferably identical with the edge 15 of the zone of low resistance 14.

In FIGS. 9 and 10, the leaves 18 and 19 have stiffeners 38 distributed across the surface of the leaf 18 or 19, in addition to the stiffener 37. The stiffeners 37 and 38 extend between the edges 15 and 16 of the vertical zone of low resistance 13 and the respective side edges 2 and 3 of the shutter 1.

In order to permit the winding of the shutter 1 on the drum 7, the stiffeners 37 and 38 extend approximately horizontally and across the direction of movement of the shutter 1.

The stiffeners 37 and 38 may, for example, be made of metal or plastic strips incorporated into the shutter 1. If metal strips are used, they may be integrated into the electrical circuit which forms part of the aforementioned detection systems.

In a variation of this embodiment of the invention, the stiffeners 37 and 38 of one of the leaves 18 or 19 are connected to, but detachable from, the corresponding stiffeners 37 and 38 of the other leaf 18 or 19. The contact thus formed between the stiffeners 37 and 38 across the zone of low resistance 13 can constitute a contact to allow it to be determined whether the shutter 1 has been broken at the location of the area of low resistance 11.

The edges 15 and 16 of the zone of low resistance 13 of the shutter 1 are preferably fitted with magnets to reconnect said edges automatically if the leaves 18 and 19 are returned to the plane of shutter 1 by automatic closure systems and the area of low resistance is restored.

For the sake of clarity, the electrical circuit which constitutes part of the aforementioned detection systems has been omitted from FIGS. 9 to 11.

In yet another variation of the inventive system, the automatic closure systems include a spring, e.g. a helical spring, which connects the upper stiffeners 37 of the leaves 18 and 19.

A highly advantageous embodiment of the inventive shutter system is shown in FIGS. 12 to 21. In this embodiment, the shutter 1 has a T-shaped area of low resistance 11. A first zone 13 of this area of low resistance 11 extends from the lower edge 4 of the shutter 1 to a second zone 14 of this area of low resistance 11, which extends approximately horizontally between the side edges 2 and 3 of the shutter 1.

The area of low resistance 11 includes three zips 39, 40 and 41. Said zips 39, 40 and 41 consist of two bands fitted with teeth which engage in each other by means of a slider. The first zip 39 coincides with the first zone 13 of the area of low resistance 11.

The second zip 40 extends from the side edge 2 of the shutter 1 to the first zone 13 of the area of low resistance 11, whilst the third zip 41 extends between the other side edge 3 of the shutter 1 and said first zone 13 of the area of low resistance 11. The arrangement of the zips 39, 40 and 41 represents a T shape and essentially corresponds to the area of low resistance 11.

In this way, the edges of the area of low resistance 11 are connected by zips and the area of low resistance 11 thus defines two leaves 18 and 19 in the shutter 1.

The first zip 39 thus extends approximately vertically, is connected firstly to the side edge of the leaf 18 by a tape 42 fitted with teeth and secondly to the side edge of the other leaf 19 by a tape 43 fitted with teeth. When the shutter 1 is closed, tapes 42 and 43 are engaged in each other.

In order to be able to break the area of low resistance 11 when a person wishes to pass through the opening which is closed by the shutter 1, tapes 42 and 43 are not engaged along part of the zip 39. In particular, at point 44, which is shown by the diagram of two hands 45, one or more teeth have been removed from the zip 39. In this way, point 44 constitutes a point of commencement of breakage of the area of low resistance 11. In particular, due to the lack of teeth, tapes 42 and 43 of the zip 39 will disengage by simply pushing at the point of commencement 44, opening it.

Figure 13:
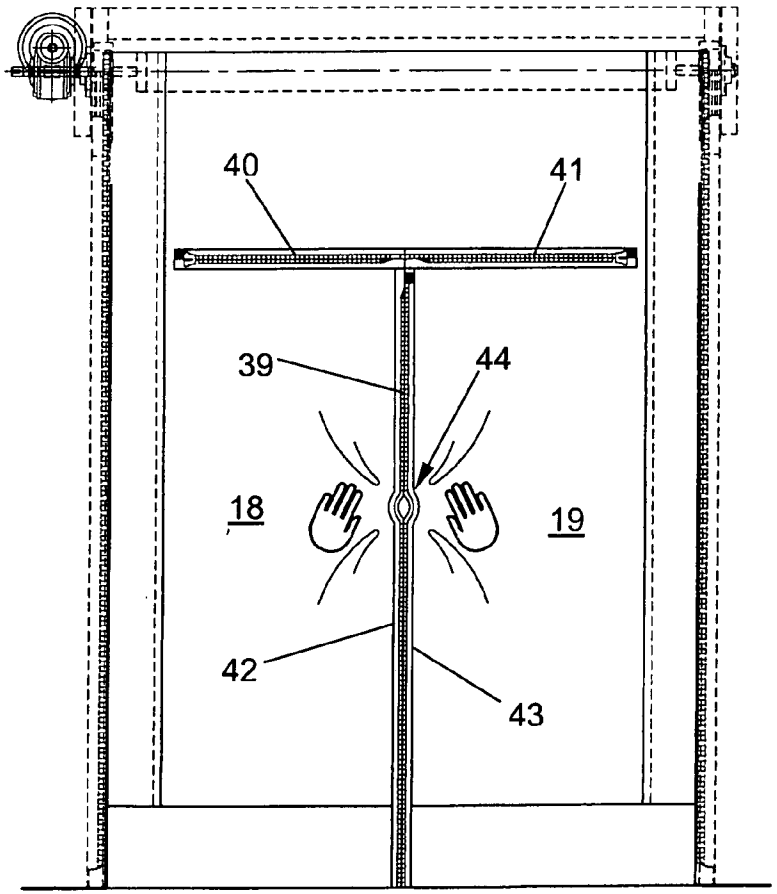
FIGS. 13 to 16 show the successive stages when the shutter in FIG. 12 is broken in the area of low resistance and the leaves are formed.
Figure 14:
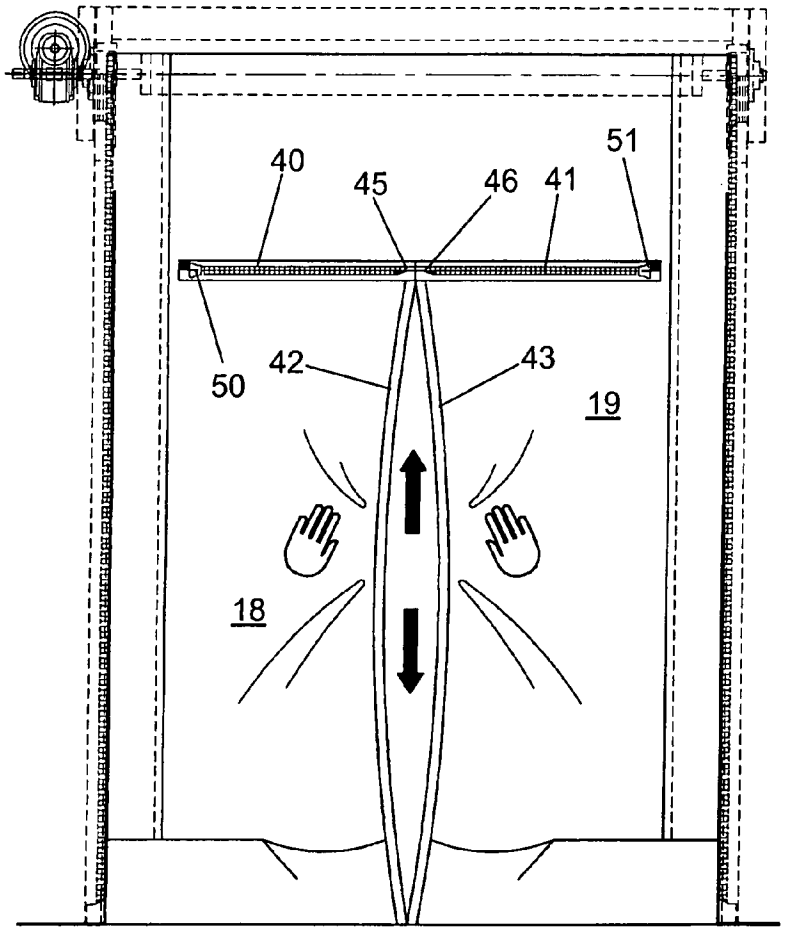

FIGS. 13 and 14 provide a diagrammatic illustration of how the zip 39 is opened from the point of commencement 44 by the disengagement of tapes 42 and 43 from said point 44.

Figure 18:
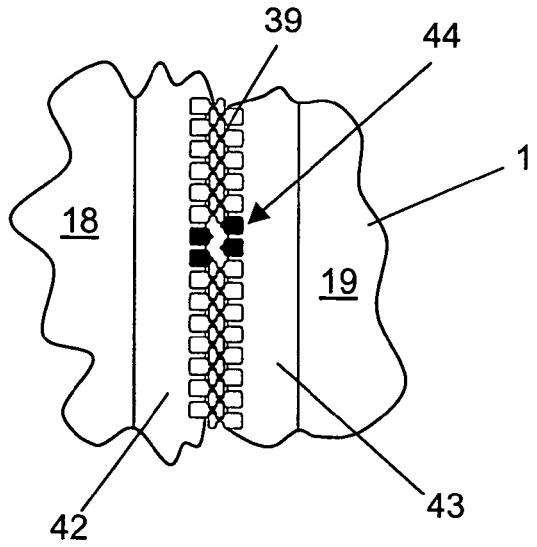
FIG. 18 shows a detail of the area of low resistance from FIG. 12 on a larger scale.

The point of commencement 44 is shown in detail in FIG. 18. In this figure, two teeth from the tape 42 and two opposite teeth from the tape 43 have been cut out in order to form the point of commencement 44. These teeth are shown in black. Tapes 42 and 43 will not engage between the teeth which have been cut out.

Figure 15:
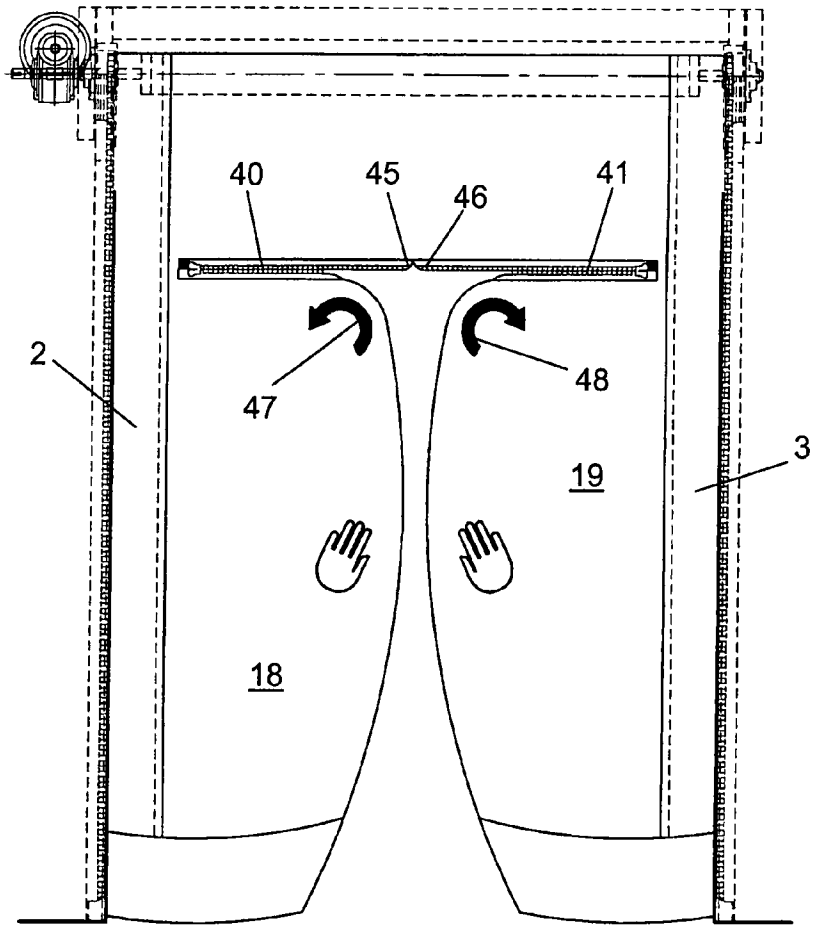
Figure 16:
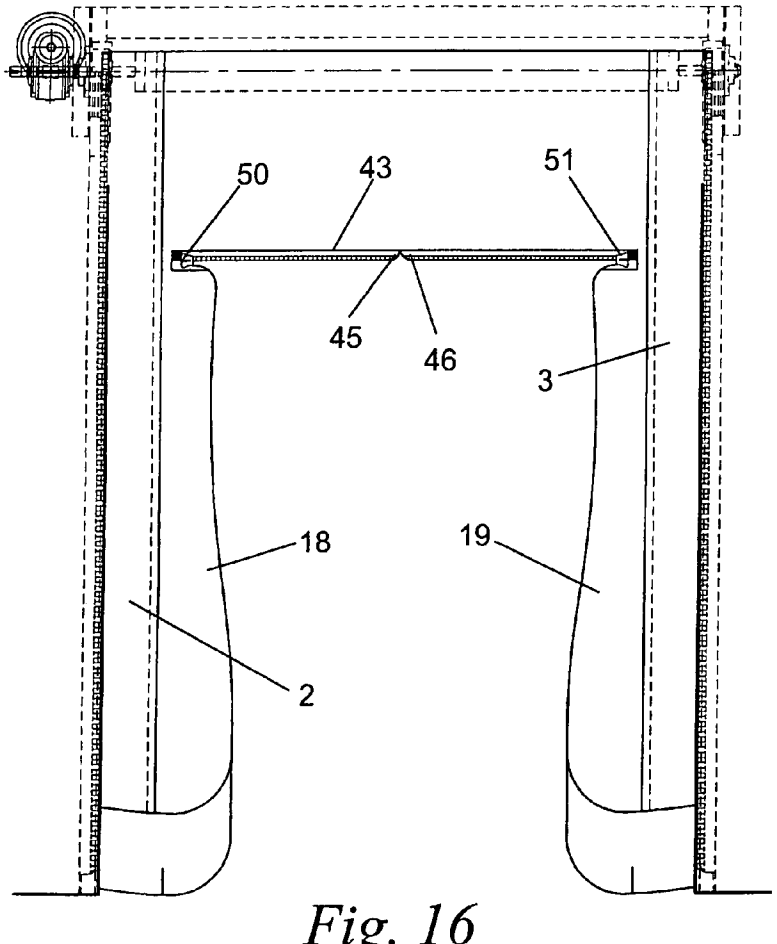

When the zip 39 is opened, zips 40 and 41, of which the opposite ends on side edges 2 and 3 of the shutter 1 are located in the vicinity of the upper end of zip 39, are opened automatically, as they are not held by the slider, as shown in FIG. 15 and indicated by the arrows 47 and 48. The area of low resistance 11 is thus broken in its entirety and the two leaves 18 and 19 are freed, so that a person may pass through the opening closed by the shutter 1, as shown in FIG. 16.

A slider 49, 50 and 51 is provided on each of the zips 39, 40 and 41 to close the passage formed by the breakage of shutter 1 in the location of the area of low resistance 11 and to restore the latter In a first stage, the sliders 49, 50 and 51 are situated in a starting position for closing the access aperture. This starting position is located at the upper end of the vertical zip 39 and the ends 45 [sic] and 46 of the horizontal zips 40 and 41.

Each zip 39, 40 and 41 has a pin 53 for the respective slider at its starting point in order to permit engagement of the tapes 42 and 43 with each other when the corresponding zips 39, 40 and 41 are closed by the movement of the sliders towards the other end of the zip in question in the direction indicated by the arrows 52.

In this way, the area of low resistance 11 is restored and the access opening is closed.

Figure 19:
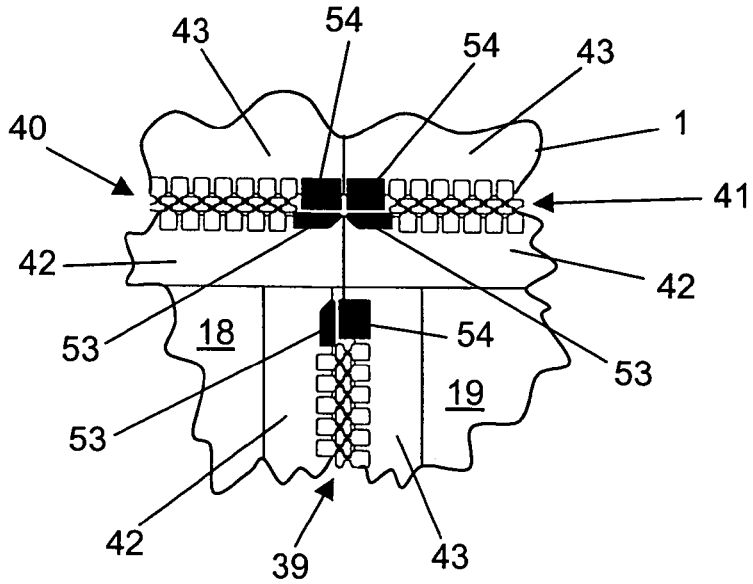
FIG. 19 shows the upper end of the vertical zip and the ends of the horizontal zips of the shutter system in FIG. 12 in detail.

FIG. 19 shows a detail of the upper end of the vertical zip 39 and of the ends 45 and 46 of the horizontal zips 40 and 41 when the access aperture has been closed. As clearly illustrated, the pin 53 is provided on the tape 42 of the zips 39, 40 and 41, whilst the other tape 43 has a stop 54 which prevents the slider from running off the teeth of this tape 43.

Figure 12:
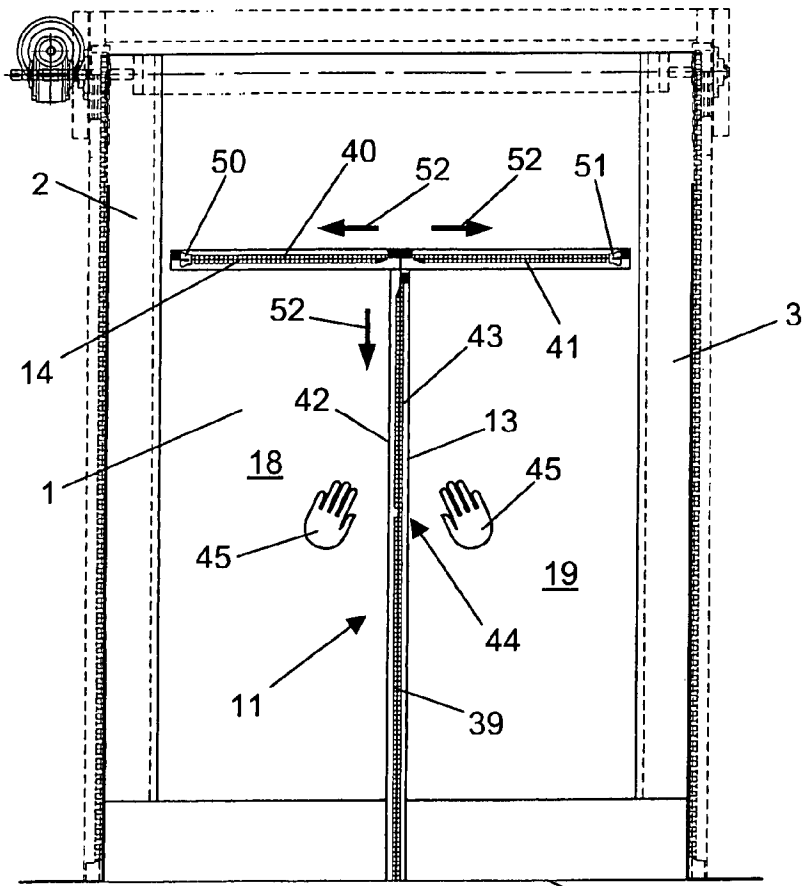
FIG. 12 is a diagrammatic front elevation of a highly advantageous embodiment of an inventive shutter system.
Figure 20:
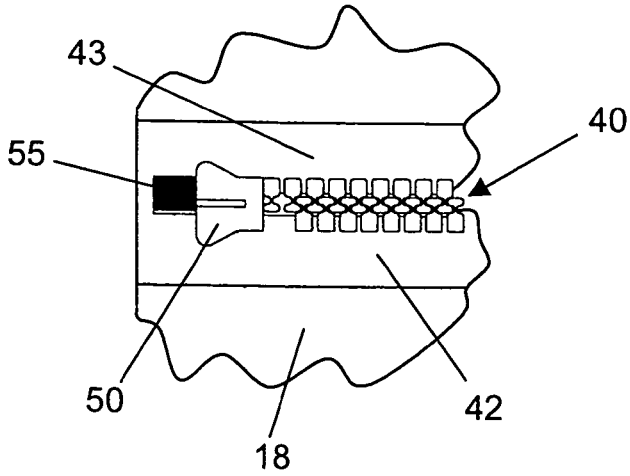
FIG. 20 shows the end of the area of weak resistance in the vicinity of a side edge of the shutter in FIG. 12.

After the area of low resistance has been restored by the closure of the zips 39, 40 and 41, the sliders 49, 50 and 51 are placed in a parked position as illustrated in FIG. 12 and in detail in FIG. 20.

FIG. 20 shows, in particular, the end of the area of zip 40 in the vicinity of the side edge 2 of the shutter 1. The upper tape fitted with teeth 43 extends beyond the tape fitted with teeth 42. The slider 50, which is located in its parked position, rests against a stop 55 and closes the teeth of the tape 43 in the vicinity of said stop 55. In this way, when the zip 40 is opened, the tapes 42 and 43 of said zip 40 can be separated entirely, as illustrated by FIG. 16.

To close the access aperture in the shutter 1, the slider 50 is moved along the teeth of the tape 43 towards the aforementioned starting position as far as the stop 54 which is located at the other end 45 of the zip 40. The pin on the tape 42 is then inserted in the slider 50, which is then moved towards the parked position, engaging the tapes 42 and 43 with each other.

The end of the zip 41 in the vicinity of the side edge 3 and the lower end of the zip 39 take an analogous form.

Figure 17:
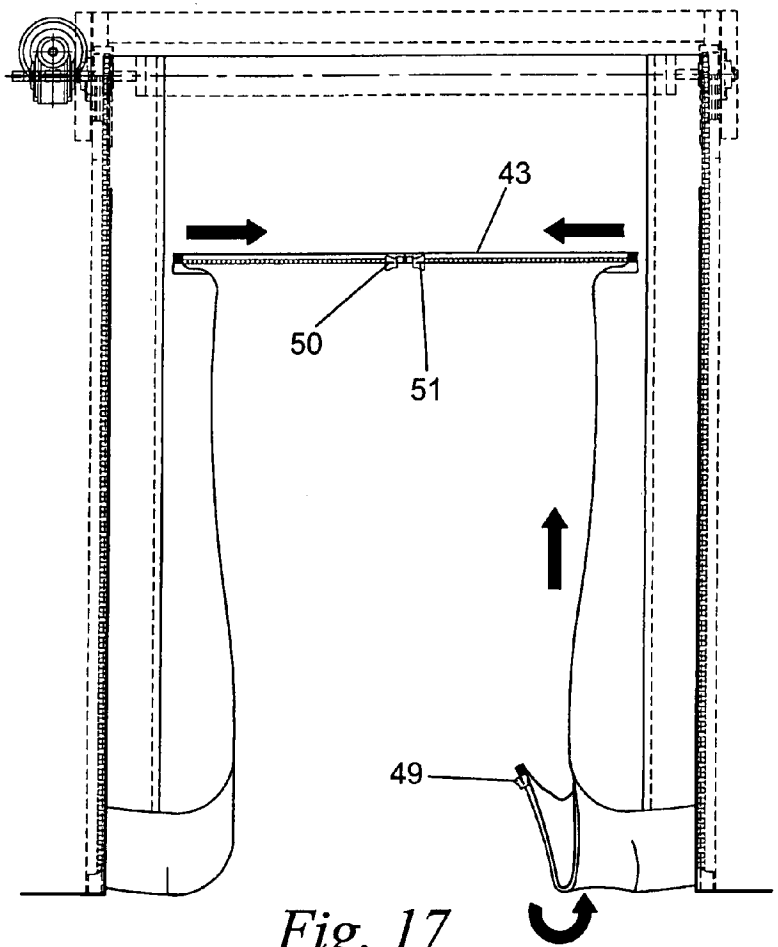
FIG. 17 is a view analogous to that in FIG. 12, of preparation of the shutter system to restore the area of low resistance.

To prevent the area of low resistance 11 being broken when the shutter 1 is closed by movement along the guide tracks 8 and 9 if an obstruction is present below the shutter 1, the lower end of the zip 39 is folded over at the lower edge 4 of the shutter 1. The corresponding tapes fitted with teeth 42 and 43 are folded over in the same way, re-ascending vertically for a certain distance. FIG. 17 shows diagrammatically that the lower end of the tape 43 is folded back on itself.

If a shutter 1 is used, of which the area of low resistance 11 is made up of one or more zips with one or more points of commencement 44, breakage of the shutter 1 at the location of the area of low resistance 11 by, for example, wind, must be avoided. An access aperture in the shutter 1 is created only by relatively low pressure at the point of commencement 44. Two points of commencement 44 should preferably be provided in the vertical zip 39. A first point of commencement 44 is located at a suitable height for adults, whilst a second point of commencement 44 is located at a height suitable for children. The point of commencement is, in particular, provided at human chest height so that a person can push against the shutter 1 easily at this point in order to break the area of low resistance 11 to create an access aperture in the shutter 1.

Although the area of low resistance 11 is formed by zips which have two tapes 42 and 43 fitted with teeth in the embodiment described above, it is evident that said tapes 42 and 43 need not necessarily have teeth, but that the tapes themselves may, for example, be made of plastic and have a shaped edge so that one tape may be gripped by the other. Such plastic tapes thus form a fastening known as a zip. A slider may be provided in order to be able to connect the two tapes to each other easily so that they can be detached again. If such plastic tapes are used, a point of commencement is formed, ensuring that the tapes cannot interlock over a certain part of their length. For example, at least one of the two tapes will not be shaped at the point of commencement 44.

Figure 21:
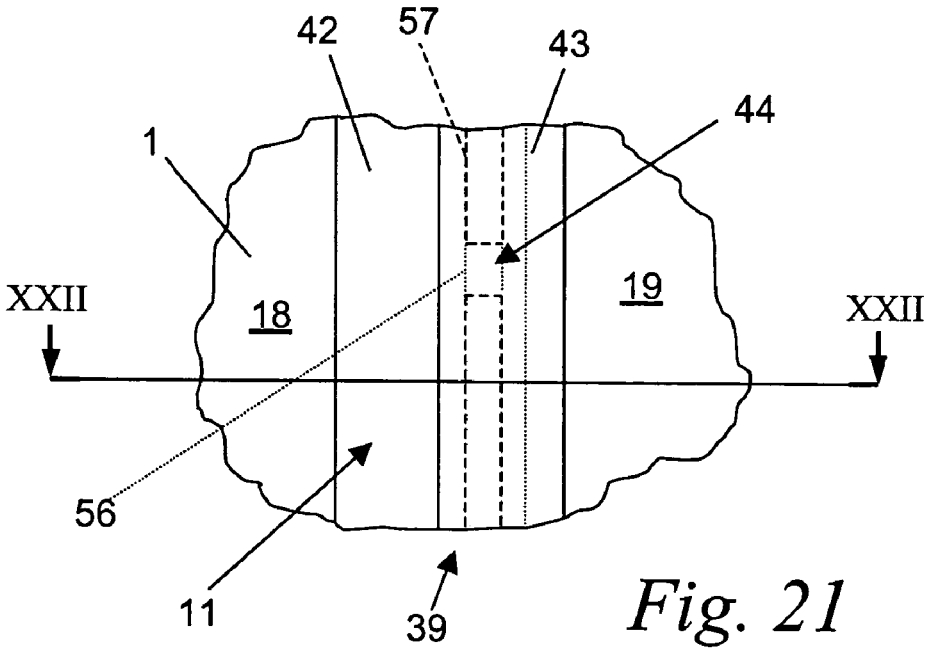
FIG. 21 is a diagrammatic front elevation of part of the area of low resistance and of the shutter in an alternative embodiment of the embodiment of the invention in FIGS. 12 to 20.
Figure 22:
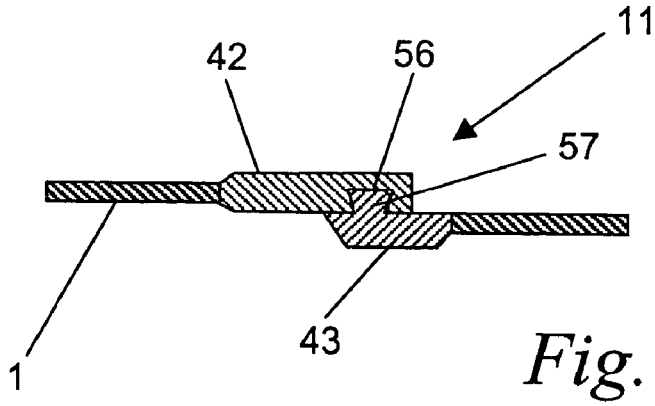
FIG. 22 is a horizontal section along the line XXII—XXII in FIG. 21.
Figure 23:
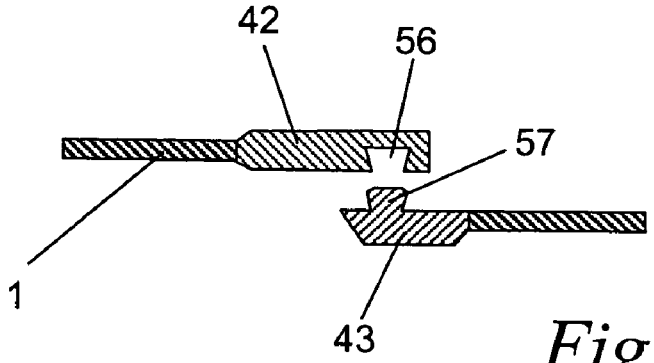
FIG. 23 is a view analogous to that in FIG. 22 when the area of low resistance has been broken.

This embodiment is shown diagrammatically in FIGS. 21 to 23. The area of low resistance 11 consists of two plastic tapes 42 and 43, forming a zip 39. Tape 42 is connected to the side edge of the leaf 18 and tape 43 is connected to the side edge of the other leaf 19.

The first strip 42 has a groove 56 along its length, which combines with a tongue 57 extending along the length of the second strip 43. When pressure is exerted on the strip 43, the tongue 57 is enclosed in the groove 56 of the other strip 43. Such pressure may, for example, be applied by a slider, not shown in the figures. Preferably, at least the tongue 57 is compressed when it is inserted in the groove 56.

A point of commencement 44 is provided in the zip 39 in order to permit breakage of the area of low resistance 11 if a person wishes to pass through the opening which is closed by the shutter 1. The tongue 57 has been removed for a short distance, e.g. several centimetres, at this point of commencement 44. In this way, tapes 42 and 43 cannot interlock over part of their length at this point 44. Tapes 42 and 43 of the zip 39 will be disengaged by simply pushing at this point of commencement 44, opening the two leaves 18 and 19.

It is self-evident that the invention is not restricted to the various embodiments described above and that other variations may be envisaged without departing from the scope of this invention, particularly with respect to the shape and type of the area of low resistance 11 and the manner in which the edges of this zone are connected. For example, the flexible leaves 18 and 19 may be connected together by magnets extending the length of the area of low resistance 11 of the two edges of this zone, or by tapes which engage in each other by means of textile fibres, e.g. those known by the brand name "Velcro".

The contacts may, for example, take the form of a permanent magnet surrounded by a solenoid. In such a case, the magnet is connected to the edge of the area of low resistance opposite the edge on which the solenoid is connected, so that if the shutter 1 is broken at the location of the area of low resistance 11, the magnet will be separated from the solenoid and an electrical signal sent to the control systems 22.

The detection systems may include an electronic eye mounted, for example, on the guide tracks, which detects whether part of the shutter 1, such as leaf 18 or 19, is outside the plane of the shutter 1.

In other respects, the invention is not restricted to a shutter of which the side edges are moved in vertical guide tracks, but may also have guide tracks which extend horizontally.

In addition, the area of low resistance is not restricted to a T shape, but may take any shape, for example, a vertical or diagonal line.

Although the inventive shutter system is described with a winding drum 7, it is evident that the presence of such a drum is not always necessary. In certain cases, the guide tracks may extend vertically or horizontally above the opening 5, so that, during opening of the shutter, its side edges may be located in that part of the guide tracks above the opening 5. It is also possible to provide a box above the opening 5, into which the shutter can fold during opening.

What is claimed is:

1. Flexible shutter system combined with a drive system in such a way as to permit the shutter (1) to move vertically between a closed position and an open position, said shutter (1) being intended to close an opening (5) or other aperture, wherein the shutter (1) has at least one area of low resistance (11), to allow at least one access aperture to be created when the shutter (1) is broken at the location of said area of low resistance (11), wherein the area of low resistance (11) contains at least two tapes (42, 43) which are engageable with each other by least one slider (49, 50, 51), whereby at least one point of commencement (44) of breakage of the area of low resistance (11) is provided where the tapes (42, 43) cannot interlock over a certain part of their length.

2. System in accordance with claim 1, characterized by the fact that the aforesaid area of low resistance (11) extends essentially vertically from the lower edge (4) of the shutter (1).

3. System in accordance with claim 1, characterized by the fact that the shutter (1) has a zone of low resistance (14) which extends approximately horizontally between the side edges (2, 3) of the shutter (1).

4. System in accordance with claim 1, characterized by the fact that the above-mentioned area of low resistance (11) is formed by a cutout in the shutter (1) of which the edges (15, 16) are connected in detachable way.

5. System in accordance with claim 4, characterized by the fact that the edges (15, 16) of the area of low resistance (11) overlap at least partially.

6. System in accordance with claim 1, characterized by the fact that the area of low resistance (11) contains at least one closure (39, 40, 41) comprising said two tapes which are fitted with teeth (42, 43) and which can engage in each other by said at least one slider (49, 50, 51), said closure (39, 40, 41) extending substantially in the direction of said area of low resistance (11).

7. System in accordance with claim 6, characterized by the fact that the zip (39, 40, 41) is provided with the at least one point of commencement (44).

8. System in accordance with claim 1, characterized by the fact that systems are provided to place the slider (49, 50, 51) in its parked position so that the tapes of the closure (39, 40, 41) can be separated in their entirety.

9. System in accordance with claim 1, characterize by the fact that detection systems are provided to allow detection of whether the area of low resistance (11) has been broken, said detection systems combining with the drive system in order to prevent the shutter (1) from moving if it is broken at the location of the area of low resistance (11).

10. System in accordance with claim 9, wherein the aforementioned detection systems include an electrical circuit (23) connected to the drive system (10) which is broken if the shutter (1) is broken at the location of the area of low resistance (11).

11. System in accordance with claim 10, characterized by the fact that the aforementioned electrical circuit (23) has at least one contact (24) containing an electrical conductor on each of the edges (15, 16) of the area of low resistance (11), the electrical conductor on one edge (15, 16) making contact with the electrical conductor on the other edge (16, 15), when said edges (15, 16) are connected, said contact being opened if the shutter (1) is broken at the location of the area of low resistance.

12. System in accordance with claim 11, characterized by the fact that the aforesaid electrical circuit (23) contains several contacts (24) which are connected in series.

13. System in accordance with claim 11, characterized by the fact that the aforementioned contact (24) is formed by a press-stud (17) consisting of a button (26) connected to one of the edges of the area of low resistance (11) and a stud (26) connected to the other edge of the area of low resistance.

14. System in accordance with claim 9, characterized by the fact that the detection systems include an electronic eye allowing detection of whether part of the shutter (1) is located outside the plane of the shutter (1) or whether an obstruction is present in the vicinity of the shutter (1).

15. System in accordance with claim 1, characterized by the fact that automatic closure systems are provided, allowing automatic closure of the aforementioned access aperture.

16. System in accordance with claim 1, characterized by the fact that the shutter has at least one stiffener (37, 38), extending approximately across the direction of movement of the shutter (1) between the area of low resistance (11) and at least one side edge (2, 3) of the shutter (1).

17. Flexible shutter system combined with a drive system in such a way as to permit the shutter (1) to move vertically between a closed position and an open position, said shutter (1) being intended to close an opening (5) or other aperture, wherein the shutter (1) has at least one area of low resistance (11), which, in the closed position, extends from a lower edge (4) of the shutter (1) to a certain height, on the latter, to allow at least one access aperture to be created when the shutter (1) is broken at the location of said area of low resistance (11), wherein the area of low resistance (11) contains at least one zip having two tapes (42, 43) and teeth which can engage in each other by a zip slider (49, 50, 51);

wherein the zip (39, 40, 41) is provided with at least one point of commencement (44); and wherein the teeth of at least one of said tapes (42, 43) have been removed at least in part at the point of commencement (44).

18. Flexible shutter system combined with a drive system in such a way as to permit the shutter (1) to move vertically between a closed position and an open position, said shutter (1) being intended to close an opening (5) or other aperture, wherein the shutter (1) has at least one area of low resistance (11), which, in the closed position, extends from a lower edge (4) of the shutter (1) to a certain height on the latter, to allow at least one access aperture to be created when the shutter (1) is broken at the location of said area of low resistance (11), wherein the area of low resistance (11) contains at least two tapes (42, 43) which can engage in each other by at least one slider (49, 50, 51);

wherein systems are provided to place the slider (49, 50, 51) in a parked position so that the tapes of the closure (39, 40, 41) can be separated in their entirety; and wherein the teeth of one of said tapes (43) extends beyond the teeth of the other tape (42) so that the slider (49, 50, 51) can be placed in said parked position on the first tape (43).

19. Flexible shutter system combined with a drive system in such a way as to permit the shutter (1) to move vertically between a closed position and an open position, said shutter (1) being intended to close an opening (5) or other aperture, wherein the shutter (1) has at least one area of low resistance (11) , which, in the closed position, extends from a lower edge (4) of the shutter (1) to a certain height on the latter, to allow at least one access aperture to be created when the shutter (1) is broken at the location of said area of low resistance (11), wherein the area of low resistance (11) contains at least two tapes (42, 43) which can engage in each other by at least one slider (49, 50, 51);

wherein an automatic closure systems are provided, allowing automatic closure of the access aperture; and wherein the automatic closure system includes at least one elastic connection (31, 32) connecting the edges (15, 16) of the area of low resistance (11) in such a way as to return said edges (15, 16) to the plane of the shutter (1).

20. Flexible shutter system combined with a drive system in such a way as to permit the shutter (1) to move vertically between a closed position and an open position, said shutter (1) being intended to close an opening (5) or other aperture, wherein the shutter (1) has at least one area of low resistance (11), which, in the closed position, extends from the lower edge (4) of the shutter (1) to a certain height on the latter, to allow at least one access aperture to be created when the shutter (1) is broken at the location of said area of low resistance (11), wherein the area of low resistance (11) contains at least two tapes (42, 43) which can engage in each other by at least one slider (49, 50, 51);

wherein the shutter has at least one stiffener (37, 38), extending approximately across the direction of movement of eth shutter (1) between the area of low resistance (11) and at least one side edge (2, 3) of the shutter (1); and wherein said stiffener (37, 38) extending from one side edge (2, 3) of the shutter (1) at the location of the area of low resistance (11) is connected to, but detachable from, a corresponding stiffener (37, 38) extending to the other side edge (3, 2) of the shutter (1).

* * * * *